United States Patent [19]

Bolton et al.

[11] 4,447,924

[45] May 15, 1984

[54] MOISTURE CONTROL SYSTEM FOR CONTROLLING THE AMOUNT OF CHEMICAL ADDED TO A FABRIC

[75] Inventors: Joseph A. Bolton, Queensbury, N.Y.; George R. Feehery, Waleska, Ga.

[73] Assignee: Albany International Corp., Menands, N.Y.

[21] Appl. No.: 350,086

[22] Filed: Feb. 18, 1982

[51] Int. Cl.[3] ..... D06B 15/04; D06B 21/00; D06B 23/28

[52] U.S. Cl. ..... 8/151; 15/319; 68/19.1; 68/20; 68/22 R; 68/62; 134/18; 134/21; 162/198; 162/252; 162/279

[58] Field of Search ..... 8/151; 68/19.1, 20, 68/22 R, 62; 15/319; 134/18, 21; 162/198, 252, 278, 279, 364

[56] References Cited

U.S. PATENT DOCUMENTS

| | | | |
|---|---|---|---|
| 3,250,099 | 5/1966 | North et al. | 68/62 |
| 3,797,281 | 3/1974 | Norton | 68/20 X |
| 3,806,405 | 4/1974 | Heidweiller | 68/20 X |
| 4,398,996 | 8/1983 | Bolton et al | 162/198 |
| 3,997,928 | 12/1976 | Leifeld | 68/62 X |
| 4,329,201 | 5/1982 | Bolton | 162/252 X |

FOREIGN PATENT DOCUMENTS

| | | |
|---|---|---|
| 888990 | 2/1962 | United Kingdom. |
| 1234649 | 6/1979 | United Kingdom. |
| 2102162 | 1/1983 | United Kingdom. |

OTHER PUBLICATIONS

EVAC Technical Report No. 107—By Paul Mickler—May 1, 1980

*Primary Examiner*—Philip R. Coe
*Attorney, Agent, or Firm*—Kane, Dalsimer, Kane, Sullivan & Kurucz

[57] ABSTRACT

A moisture control system is provided for controlling the amount of chemical added to a fabric. The system includes a suction pipe having a slot therein and a fabric positioned to pass over the slot. A vacuum source is connected through conduit means to the suction pipe. A source of liquid is provided including a predetermined percentage of chemical therein to be added to the fabric. Liquid from the liquid source is added to the fabric and the fabric containing the liquid from the liquid source is advanced over the suction pipe whereupon vacuum is applied to the fabric to deliquefy it. The vacuum source is set to provide a predetermined vacuum depending on the chemical concentration of the liquid and the composition of the fabric. As the fabric passes over the slot a change in the vacuum is sensed and the vacuum source is actuated to retain the vacuum to the predetermined condition thereby maintaining a constant moisture level and amount of added chemical in the fabric.

27 Claims, 1 Drawing Figure

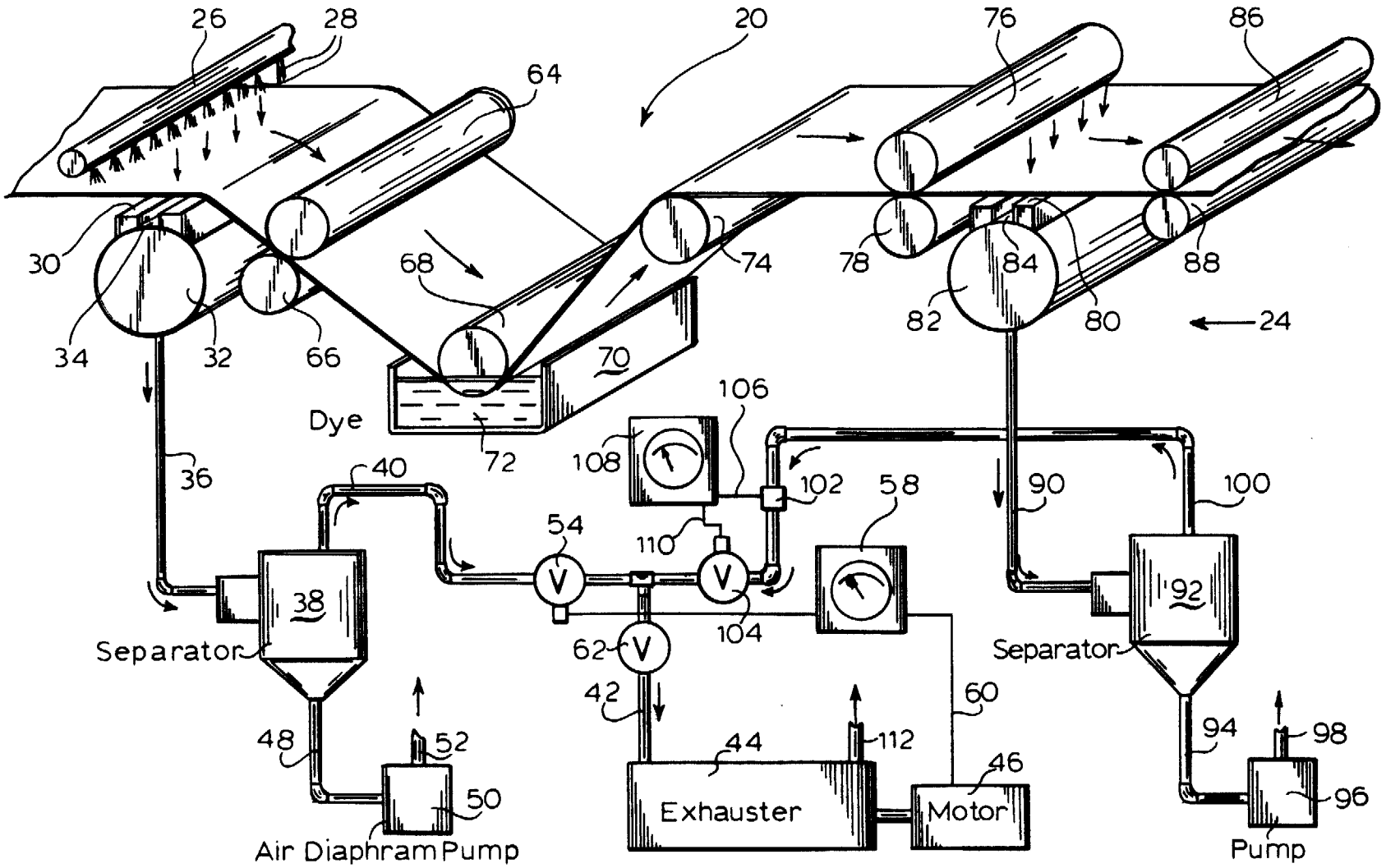
Pump
Separator
Motor
Exhauster
Dye
Air Diaphram Pump
Separator

MOISTURE CONTROL SYSTEM FOR CONTROLLING THE AMOUNT OF CHEMICAL ADDED TO A FABRIC

BACKGROUND OF THE INVENTION

In the textile industry, it is common practice to apply textile dyes and finishing chemicals to cotton and cotton polyester woven fabrics to impart color and to enhance comfort and ease of care of the fabrics in use. The goods are prepared by known procedures such as de-sizing, bleaching and/or mercerizing. After the preparation stage, the goods are dried prior to dyeing or finishing. If the goods are dyed, they will also be subsequently dried and then finished.

A textile fabric is normally rewet with water after it leaves the preparation stage and then is squeezed with rubber squeeze rolls prior to drying. Upon exiting the squeeze rolls, the percentage of moisture in the fabric will vary from 50 percent for blends including 65 percent polyester and 35 percent cotton to 75 percent for 100 percent cotton fabrics.

Analysis has indicated that the moisture content of the fabric exiting the squeeze rolls can be lowered to 16–25 percent on a blend of 65 percent polyester and 35 percent cotton and 40–55 percent on a 100 percent cotton fabric. Most ranges run some blends and, thus, the average energy reduction is 50 percent. The average energy cost is approximately $80,000 per year per range resulting in a $40,000 yearly energy savings.

Currently, chemicals are applied in approximately a 5–10 percent solution by dipping the dry fabric in the solution and squeezing with rubber squeeze rolls. The moisture content of the fabric exiting from the squeeze roll varies from 50 percent for a fabric blend of 65 percent polyester and 35 percent cotton to 75 percent for 100 percent cotton fabric. This moisture content can vary plus or minus 10 percent side-to-side due to uneven squeezing caused either by uneven pressure or rubber roll wear. In addition, some solution is left between the woven threads in a "window pane" effect.

Fabric construction, the intended use of the fabric, and whether it is a 100 percent cotton material or a blend will effect the make-up of the chemical solution applied to the fabric. It is desirable to run as many styles as possible with one chemical solution in order to maximize production efficiency and to minimize down time effect.

There has been considerable analysis and testing done in connection with the various fabrics. The results show that the percentage of moisture in the fabric as it leaves the vacuum slot depends primarily on the polyester content, varying from 16 percent for a blend including a 70 percent polyester and 30 percent cotton to 45 percent for a 100 percent cotton fabric. There is some variance between different styles of a blend due to differences in the weave, permeability and distribution of the two different fibers.

It is known in the industry that use of vacuum systems to apply finished chemicals will produce some chemical savings. However, there are some difficulties encountered in the bare application of a vacuum system to the different variety of fabrics being treated. It has been found, for example, that using existing vacuum systems on blends of 65 percent polyester to 35 percent cotton will cause a variation from 18 to 35 percent in moisture level depending on the style permeability with the vacuums fluctuating between 15 and 4 inches of mercury. The moisture level in the fabric as it exits from the point where vacuum is applied will gradually increase during the run as the conventional type of air and liquid separator has its strainer coated with lint. The vacuum fluctuation is primarily due to differences in fabric permeability. The typical vacuum systems do not produce enough air on the open fabrics resulting in a decrease in vacuum. Thus, the mill is forced to frequently change chemical concentrations or to put on higher concentrations to take into account these inconsistencies. The result is a significant reduction in the amount of saved chemical.

Accordingly, while there is no question that the use of vacuum is a valuable tool in the dewatering of fabrics and in treating the fabrics with desirable chemical treatment, there is still room for further improvement. This is true in regard to controlling the moisture level in the deliquefying processes for polyester and cotton blends and for all cotton fabrics in particular. In addition to the consistency and control over the moisture level in the fabric as it is deliquefied, chemically treated and deliquefied again, it is also desirable to provide savings in the necessary chemicals utilized in the process to the greatest possible degree. Moisture control and greater savings in chemicals are consistently desired. This is particularly true in industrial environments where cost is a significant factor in regard to materials, energy, and the close control over the process for dependability and reproducibility over an extended period of time.

SUMMARY OF THE INVENTION

With the above background in mind, it is among the primary objectives of the present invention to provide an improved moisture control system for controlling the amount of chemical added to a fabric. Close control is maintained over the percentage of various chemicals added to the fabric and this is facilitated by utilizing a controlled vacuum system to maintain a constant vacuum applied to the fabric for a predetermined blend of polyester and cotton material and a predetermined chemical concentration in the solution used to treat the fabric.

An objective is to provide a means for maintaining a desired moisture level in the fabric as it exits a vacuum dewatering location.

It is an objective of the present invention to provide a moisture control system for controlling the percentage of moisture level in the fabric after introduction to a chemical solution thereby controlling the amount of chemical used in treatment of the fabric.

The system is designed to be calibrated so that a constant vacuum is applied to a given fabric to produce a constant moisture level in the particular fabric and thus produce a predetermined amount of chemical treatment to the fabric. The calibration is achieved by determining the desired vacuum level for the composition of fabric and the chemical concentration used to wet the fabric. Thus, the deliquefying procedure is accomplished by closely controlling the vacuum means so that a constant predetermined vacuum is always applied to the fabric. The vacuum setting is dependent on the blend of the fabric and the chemical concentration of the added chemical solution. The ultimate closely controlled percentage of moisture level remaining in the fabric after exiting the location for application of the vacuum will remain constant at a predetermined value.

It is contemplated that the control system for maintaining the predetermined moisture level in the fabric can be integrated with a fabric handling system whereby the fabric can be treated with liquid and initially dried, then passed through a chemical solution for application of the desired concentration of chemical to the fabric, and thereafter be introduced to the control system for deliquefying the fabric and leaving a desired moisture level in the fabric.

It has been found effective for the present invention to provide a centrifugal exhauster as the vacuum means interconnected with conduits to a suction pipe. A vacuum controller is used to adjust a valve depending upon the vacuum demand at the suction pipe. A vacuum sensing device at the suction pipe sends a signal to a controller which regulates a valve to maintain a constant vacuum in the suction pipe and applied to the fabric through the slot in the pipe.

It is also contemplated that a vacuum means in the form of a positive displacement pump can be used with appropriate conduits to apply vacuum to a suction pipe whereby the fabric along a continuous travel path can be wet, dewatered and dried, introduced to the chemical solution, and ultimately passed over the controlled suction pipe for deliquefying the fabric to a desired moisture level at a constant vacuum thereby closely controlling the percentage of chemical added to the fabric.

The system is designed so that appropriate liquid/air separators can be incorporated in the conduit path between each of the suction pipes and the vacuum means so that the air/liquid mixture collected in the pipe can be separated and the air passed to the vacuum means while the liquid is separately removed from the separator.

In summary, a moisture control system is provided for controlling the amount of chemical added to a fabric. The system includes a suction pipe having a slot therein and a fabric positioned to pass over the slot. Vacuum means is connected by conduit means to the suction pipe. A source of liquid is provided including a predetermined percentage of chemical therein to be added to the fabric. Means is provided for applying liquid from the liquid source to the fabric. Means is provided for advancing the fabric containing liquid from the liquid source over the pipe whereupon vacuum is applied thereto to deliquefy the fabric. The vacuum means is adapted to be set to provide a predetermined vacuum depending on the chemical concentration of the liquid and the composition of the fabric. Sensing means is provided for sensing a change in the vacuum and the vacuum means is responsive to the change sensed by the sensing means to adjust the vacuum and return it to the predetermined condition thereby maintaining a constant moisture level and amount of added chemical in the fabric.

With the above objectives among others in mind, reference is made to the attached drawing.

BRIEF DESCRIPTION OF THE DRAWING

The FIGURE of the drawing is a schematic view of the moisture control system of the invention incorporated as part of a system for treatment of a fabric.

DETAILED DESCRIPTION

The drawing in the FIGURE shows a system 20 for treating a continuous web of fabric 22 passing from left to right as shown in the drawing and subjecting the web to a variety of process steps. The moisture control system of the present invention for controlling the amount of chemical added to the fabric is shown on the right hand side of the drawing incorporated in the overall system 20. System 24 of the invention, which is part of larger system 20, is shown in this manner for ease of understanding as to how it may be employed in industrial treatment of the fabric 22.

As shown, fabric 22 first encounters an overhead shower 26 which applies liquid 28, such as water, to the cross section of fabric 22. The fabric then travels across the wear surface 30 of a suction pipe 32 having a transverse slot 34 in its upper surface. The suction pipe arrangement is a conventional and well known in the art. Arrows show the direction of air flow through the fabric 22 and into the pipe 32.

A conduit 36 extends from the suction pipe to a conventional liquid/air separator 38. A conduit 40 extends from the upper end of separator 38 to a conduit 42 which is interconnected with a suitable vacuum means 44. It has been found effective to employ a centrifugal exhauster as vacuum means 44. An exhauster such as that manufactured by Hoffman Air and Filtration System of Syracuse, New York would work effectively for the type of constant vacuum system shown. Alternatively, if a liquid ring pump is to be employed, a unit such as that manufactured by Nash Engineering of Norwalk, Connecticut would work effectively. Motor 46 is provided to drive exhauster 44. A second conduit 48 extends from the bottom end of separator 38 and is interconnected with a conventional air diaphragm exhaust pump 50 which has an exhaust pipe 52 extending therefrom. A control valve 54 is positioned in conduit 40 and is electrically connected through wire 56 to a control panel 58. Control panel 58 in turn is connected by electrical conduit 60 to motor 46 for utilizing full vacuum capacity of the pump 44. A master shut-off valve 62 is in the system for manually controlling the flow of air directly to exhauster 44 through conduit 42 when the vacuum means is operating.

After the fabric passes from wear surface 30 of suction pipe 32, it is controlled, advanced and directed between a pair of opposing pull rolls or dry cans 64 and 66. The fabric 22 is directed from the pull rolls 64 and 66 beneath a guide roll 68 disposed in a vat 70. The vat 70 contains a predetermined amount of solution 72. The solution 72 has a predetermined concentration of chemical to be added to the fabric.

The fabric then travels over a further guide roll 74 and between a pair of opposing squeeze rolls 76 and 78. The squeeze rolls 76 and 78 act as a guideway for the fabric on its travel path and also provides a preliminary degree of deliquefying of the fabric.

The fabric then passes over the wear surface 80 of a second suction pipe 82 so that suction applied through the slot 84 in the upper surface of the pipe and across the transverse width of the fabric will draw air through the fabric and collect a mixture of air and liquid from the fabric within the pipe 82. The vacuum applied through slot 84 is at a predetermined constant level as the fabric travels thereacross so that the percentage of moisture level in the fabric as it exits the slot 84 is constant thereby producing a constant percentage of chemical added to the fabric.

The fabric 22 in this condition then is passed on for further conventional processing through a pair of opposing drive rolls 86 and 88. Suitable conventional means (not shown) is provided to advance the fabric through the system in the manner just described.

A conduit 90 interconnects the hollow suction pipe 82 with a conventional air/liquid separator 92. A conduit 94 from the bottom end of separator 92 is interconnected with a pump 96 for removal of separated liquid. The pump 96 has a suitable discharge opening for transferring the separated liquid to a desired location.

A conduit 100 exits from the upper end of separator 92 and is interconnected with conduit 42 and the vacuum means in the form of the positive displacement pump 44. In this manner, pump 44 can service both suction pipes in the system by the T arrangement of conduits formed by conduit 42, conduit 40 and conduit 100.

Intermediate the ends of conduit 100 is a conventional sensing device 102 and a vacuum controller 104 including a control valve. The sensing means 102 is connected by electrical conduit 106 to a control panel 108. Similarly, vacuum control valve 104 is connected by electrical conduit 110 to control panel 108.

In operation, to control the chemical add-on, first, the nature of the composition of the fabric is determined. For example, it is ascertained whether the fabric is 100 percent cotton or is a blend of cotton and polyester. Next, the desired concentration of chemical solution 72 is chosen for the particular fabric. The control panel 108 is calibrated to provide a predetermined constant vacuum to slot 84 of suction pipe 82 as the fabric 22 passes thereover. In this manner, the moisture level of the fabric as it leaves slot 84 is constant thus maintaining a constant amount of chemical added to the fabric for a given fabric blend.

To assist in closely controlling the vacuum applied to the fabric, suitable end deckles are applied to slot 84 so that the suction is uniformly applied across the transverse cross section of the fabric as it passes over the slot 84.

The vacuum applied to suction pipe 32 prior to the chemical add-on, is controlled by vacuum controller 54 and control panel 58. Thus, when fabric 22 is liquefied by shower 28 and passes over slot 54, suction applied through pipe 32 to cause a mixture of air and liquid to collect in pipe 32. This air/liquid mixture passes through conduit 36 into air/liquid separator 38 as shown by the arrows. In the separator, the liquid is separated and removed through conduit 48 by a suitable pump such as air diaphragm pump 50 which discharges the liquid to a desired location through discharge conduit 52. The separated air exits the upper end of separator 38 and passes through conduit 40 into conduit 42 and to the vacuum means 44. A suitable discharge conduit 112 on pump 44 exhausts the air.

The fabric then passes between rolls 64 and 66 and beneath roll 68 into the solution 72 in vat 70 where it collects liquid solution containing the desired chemical. The fabric 22 then passes over roll 74 and between squeeze rolls 76 and 78 where a preliminary amount of liquid solution is removed.

The fabric then passes over slot 84 where a constant vacuum is maintained for a given fabric style which will draw a mixture of air and liquid from the fabric into the suction pipe 82. Variations in fabric width, permeability, moisture content will cause a change in vacuum which is sensed by sensor 102 in conduit 100. Control panel 108 then causes vacuum controller 102 to adjust the valve opening thus adjusting the passageway to conduit 42 through which suction is applied by vacuum 44. In this manner, constant control is maintained over the vacuum in pipe 82 and accordingly the vacuum applied to given fabric 22 is constant. The result is a constant moisture level remaining in the fabric as it leaves wear surface 80 and passes between rolls 86 and 88 for further handling and processing. Since the moisture level is constant the amount of chemical added to the fabric is constant.

The collected air/liquid mixture in suction pipe 82 is directed through conduit 90 to air/liquid separator 92 as shown by the arrows. In the separator, the separated liquid is pumped through conduit 94 by pump 96 and is discharged from the pump through discharge conduit 98. The separated air is drawn through conduit 100 to conduit 42 and ultimately through pump 44 to be discharged through pump conduit 112.

It has been found that a variety of different fabric blends can be treated in this manner with resulting close control over the moisture in the fabric and in this manner the chemical add-on to the fabric. For example, blends of 65 percent polyester and 35 percent cotton can be run with a constant vacuum to produce a controlled 25 percent moisture level. Similarly, blends of 50 percent polyester and 50 percents cotton can be run at a constant vacuum to produce a constant moisture level of 35 percent. All of the runs can be run at 35 percent by varying the vacuum with a single chemical mix.

For calibration purposes, the operator is given a vacuum setting for each fabric. For example, he would be given the following chart:

| STYLE NO. | BLEND | VACUUM SETTING In Hg | CHEMICAL CONCENTRATION |
|---|---|---|---|
| 1234 | 50/50 | 12.0 | 10% |
| 1235 | 50/50 | 11.0 | 10% |
| 1236 | 50/50 | 10.0 | 10% |
| 1236 | 50/50 | 9.5 | 10% |
| 1237 | 70/30 | 11.0 | 20% |
| 1238 | 75/35 | 10.0 | 20% |

He would set the vacuum on the desired setting, and it would be automatically controlled by system 24.

Each style is calibrated for vacuum against percent add-on. This may be done either with moisture meters, nuclear gauges or manual cut and weigh methods. For example, this can be arranged in the following manner:

| VACUUM | % ADD-ON 75/25 BLEND |
|---|---|
| 12" | 15% |
| 11" | 17% |
| 10" | 20% |
| 9" | 24% |
| 8" | 30% |

The overall result is a significant energy saving as well as close control and consistency of chemical add-on and a great savings in the amount of chemical required over a prolonged length of time and with many different types and styles of fabrics.

As stated above, the overall objective of the present invention is to provide add-on control by controlling the moisture level in the fabric. This can be accomplished in several ways. The above discussed embodiment achieves the result by controlling the vacuum applied to the fabric and maintaining a constant vacuum applied to the fabric. Alternatively, a system may be used which employs a pump which produces a constant air flow under varying vacuum conditions. With a constant air flow pump system, the moisture level in the fabric is again closely controlled thus controlling the add-on to the fabric.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A moisture control system for controlling the amount of chemical added to a fabric composition comprising: vacuum means capable of applying a vacuum to fabric passing thereby; conduit means connected to the vacuum means, a source of liquid including a predetermined percentage of chemical therein to be added to the fabric; means for applying liquid from the liquid source to the fabric; means for advancing the fabric containing liquid from the liquid source passed the vacuum means whereupon vacuum is applied thereto to deliquefy the fabric; the vacuum means being calibrated to provide a predetermined amount of vacuum which leaves a predetermined percentage of moisture in the fabric and accordingly a predetermined percentage of chemical in the fabric with the predetermined amount of vacuum being a function of the predetermined percentage of chemical in the liquid and the composition of the fabric; sensing means for sensing a change in the vacuum and the vacuum means being responsive to the change sensed by the sensing means to adjust the vacuum and return it to the predetermined vacuum thereby maintaining a constant moisture level and accordingly amount of added chemical in the fabric.

2. A moisture control system for controlling the amount of chemical added to a fabric comprising: a first suction pipe having a slot therein which the fabric passes, vacuum means, conduit means connecting the first suction pipe to the vacuum means, a first liquid supply means including a predetermined percentage of chemical therein to be added to the fabric, means for advancing the fabric containing liquid from the first liquid supply means over the first suction pipe whereupon vacuum is applied thereto to deliquefy the fabric, the vacuum means being calibrated to provide a predetermined amount of vacuum which leaves a predetermined percentage of moisture in the fabric and accordingly a predetermined percentage of chemical in the fabric with the predetermined amount of vacuum being a function of the predetermined percentage chemical in the liquid and the composition of the fabric; sensing means for sensing a change in vacuum demand at the slot; the conduit means including a first vacuum controller, and the sensing means connected to the first suction pipe and the first vacuum controller so that sensing of a change in vacuum in the first suction pipe will actuate the first vacuum controller and permit the vacuum means to maintain a constant vacuum at the first suction pipe and maintain a constant moisture level and accordingly amount of added chemical in the fabric.

3. The invention in accordance with claim 2 wherein the vacuum means includes a positive displacement pump which provides a relatively constant vacuum of air flow at the pump.

4. The invention in accordance with claim 2 wherein the conduit means includes a first air/liquid separator in position to receive the mixture of liquid and air collected in the first suction pipe and to separate the mixture into air to be passed through the conduit means to the vacuum means and liquid to be removed from the first separator.

5. The invention in accordance with claim 4 wherein a second suction pipe having a slot therein which the fabric passes is positioned with respect to the fabric and the first suction pipe so that the fabric is first passed over the second suction pipe, conduit means positioned between the second suction pipe and the vacuum means and including a second vacuum controller operable to selectively interconnect the vacuum means with the second suction pipe and apply vacuum to deliquefy the fabric passing thereover.

6. The invention in accordance with claim 5 wherein the first liquid supply means is positioned between the first and second suction pipes, a second liquid supply means positioned so that the second suction pipe is between the first and second liquid supply means in the direction of travel of the fabric.

7. The invention in accordance with claim 6 wherein the second liquid supply means is a liquid shower for depositing a predetermined amount of liquid on the fabric before it passes over the slot in the second suction pipe, an arrangement of pull rolls between the second suction pipe and the first liquid supply means for further dewatering the fabric after it leaves the second suction pipe and for guiding the fabric through the first liquid supply means, compressing the fabric after it exits from the first liquid supply means to dewater the fabric, and guide rolls for guiding the fabric over the slot in the first suction pipe and directing the fabric from the first suction pipe.

8. The invention in accordance with claim 7 wherein a second liquid/air separator is mounted in the conduit means between the second suction pipe and the vacuum means to receive the mixture of liquid and air collected in the second suction pipe and to separate the mixture into air to be passed through the conduit means to the vacuum means and liquid to be removed from the second separator.

9. The invention in accordance with claim 2 wherein the first vacuum controller includes an adjustable control valve in the conduit means.

10. The invention in accordance with claim 2 wherein the first liquid supply means includes a vat containing liquid with a predetermined percentage of chemical therein to be added to the fabric, and the fabric advancing means being capable of directing the fabric into and out of the liquid in vat.

11. The invention in accordance with claim 2 which includes fabric that is a textile fabric.

12. The invention in accordance with claim 2 wherein the system is calibrated by setting the vacuum level produced by the vacuum means as a function of the fabric composition and the chemical concentration of the liquid and chemical mixture to be added to the fabric.

13. The method for controlling the amount of chemical added to a fabric in a moisture control system comprising the following steps: arranging a vacuum means with respect to a fabric so as to be able to apply a vacuum thereon; providing a source of liquid including a predetermined percentage of chemical therein to be added to the fabric; applying liquid from the liquid source to the fabric; advancing the fabric containing liquid to the vacuum means; calibrating the vacuum means to provide a predetermined vacuum which is a function of the chemical concentration of the liquid and the composition of the fabric; applying said predetermined vacuum to the fabric to deliquefy the fabric; sensing a change in the vacuum and air flow relationship; and adjusting the vacuum provided by the vacuum means responsive to the sensed change to return the vacuum to the predetermined amount of vacuum thereby maintaining a constant moisture level and accordingly amount of added chemical in the fabric.

14. The method for controlling the amount of chemical added to a fabric in a moisture control system comprising the steps of: arranging a first suction pipe having a slot therein and a vacuum means interconnected thereto by conduit means, with respect to a fabric positioned to pass over the slot; providing a first source of liquid including a predetermined percentage of chemical therein to be added to the fabric; applying liquid from the first liquid source to the fabric; advancing the fabric containing liquid from the first liquid source over the first suction pipe and applying vacuum thereto to deliquefy the fabric; setting the vacuum means to provide a predetermined vacuum at the slot depending on the chemical concentration of the liquid and the composition of the fabric; sensing a change in vacuum at the slot in the first suction pipe and actuating a first vacuum controller to permit the vacuum means to maintain a constant vacuum at the first suction pipe and thereby maintain a constant moisture level and accordingly amount of added chemical in the fabric.

15. The invention in accordance with claim 14 which further includes the steps of: providing the vacuum means with a positive displacement pump and creating a relatively constant volume of air flow at the pump.

16. The invention in accordance with claim 14 which further includes the steps of: providing the conduit means with a first air/liquid separator and positioning the first separator to receive the mixture of liquid and air collected in the first suction pipe; separating the mixture into air and passing it through the conduit means to the vacuum means; and removing the liquid from the separator.

17. The invention in accordance with claim 14 which further includes the steps of: providing the first vacuum controller with an adjustable control valve in the conduit means.

18. The invention in accordance with claim 14 which further includes the steps of: providing the first liquid source in the form of a vat containing liquid with a predetermined percentage of chemical therein to be added to the fabric, and directing the fabric into and out of the vat for accumulation of liquid thereon.

19. The invention in accordance with claim 18 which further includes the steps of: providing a second suction pipe having a slot therein and positioning it with respect to the fabric and the first suction pipe so that the fabric is first passed over the second suction pipe; providing a conduit means between the second suction pipe to the vacuum means including a second vacuum controller operable to selectively interconnect the vacuum means with the second suction pipe; and apply a vacuum to deliquefy the fabric passing thereover.

20. The invention in accordance with claim 19 which includes the steps of: positioning the liquid source between the first and second suction pipes; providing a second liquid source and positioning it so that the second suction pipe is between the first and second liquid source in the direction of travel of the fabric.

21. The invention in accordance with claim 20 which includes the steps of: providing the second liquid source in the form of a liquid shower; depositing a predetermined amount of liquid from the liquid shower on the fabric before it passes over the slot in the second suction pipe; providing an arrangement of pull rolls between the second suction pipe and the first liquid source for further dewatering the fabric after it leaves the second suction pipe and guiding the fabric through the first liquid source; compressing the fabric after it exits from the first liquid source to dewater the fabric; and providing guide rolls for guiding the fabric over the slot in the first suction pipe and directing the fabric from the first suction pipe.

22. The invention in accordance with claim 21 which includes the steps of: providing a second liquid/air separator and mounting it in the conduit means between the second suction pipe and the vacuum means to receive the mixture of liquid and air collected in the second suction pipe; and separating the mixture into air and passing the air through the conduit to the vacuum means; and removing the liquid from the second separator.

23. The invention in accordance with claim 14 which includes the steps of: providing a fabric which is a textile fabric.

24. The invention in accordance with claim 14 which includes the steps of: calibrating the system by setting the vacuum level produced by the vacuum means as a function of the fabric material and the chemical concentration of the liquid and chemical mixture to be added to the fabric.

25. A moisture control system for controlling the amount of chemical added to a fabric comprising: a first pipe having a slot therein; vacuum means; conduit means connecting the suction pipe to the vacuum means; a first liquid supply means including a predetermined percentage of chemical therein to be added to the fabric; means for advancing the fabric containing liquid from the first liquid supply means over the first pipe whereupon vacuum is applied thereto to deliquefy the fabric; the vacuum means adapted to be set to provide a predetermined vacuum at the slot depending on the chemical concentration of the liquid and the composition of the fabric; sensing means for sensing a change in vacuum demand at the slot of the first suction pipe, the conduit means including a vacuum controller; the sensing means connected to the first suction pipe and the vacuum controller so that sensing of a change in vacuum in the first suction pipe will actuate the vacuum controller and permit the vacuum means to maintain a constant vacuum at the first suction pipe and maintain a constant moisture level and amount of added chemical in the fabric; a second suction pipe is positioned with respect to the fabric and the first suction pipe so that the fabric is first passed over the second suction pipe having a conduit means connecting the second suction pipe to the vacuum means including a second vacuum controller operable to selectively interconnect the vacuum means with the second suction pipe and apply vacuum to deliquefy the fabric passing thereover; the first liquid supply means being positioned between the first and second suction pipes; a second liquid supply means positioned so that the second suction pipe is between the first and second liquid supply means in the direction of travel of the fabric; said second liquid supply means including a liquid shower for depositing a predetermined amount of liquid on the fabric before it passes over the slot in the second suction pipe; an arrangement of pull rolls between the second suction pipe and the first liquid supply means for further dewatering the fabric after it leaves the second suction pipe and for guiding the fabric through the first liquid supply source and comprising the fabric after it exits from the second liquid supply means to dewater the fabric; and guide rolls for guiding the fabric over the slot in the first suction pipe and directing the fabric from the first suction pipe.

26. The invention in accordance with claim 25 wherein respective liquid/air separators are mounted in the respective conduit means between the first and second suction pipes and the vacuum means to receive the mixture of liquid and air collected in the first and second suction pipes and to separate the mixture into air to be passed through the respective conduit means to the vacuum means and liquid to be removed from the second separators.

27. The method for controlling the amount of chemical added to a fabric in a moisture control system comprising: arranging a first suction pipe having a slot therein and a vacuum means interconnected by conduit means with respect to a fabric positioned to pass over the slot of the first suction pipe; providing a first source of liquid including a predetermined percentage of chemical therein to be added to the fabric; applying liquid from the first liquid source to the fabric; advancing the fabric containing liquid from the first liquid source over the first suction pipe whereupon vacuum is applied thereto to deliquefy the fabric; setting the vacuum means to provide a predetermined vacuum at the slot of the first suction pipe depending on the chemical concentration of the liquid and the composition of the fabric; sensing a change in vacuum demand at the slot in the first suction pipe and actuating a vacuum controller to permit the vacuum means to maintain a constant vacuum at the first suction pipe and thereby maintain a constant moisture level and amount of added chemical in the fabric; providing a second suction pipe and positioning it with respect to the fabric and the first suction pipe; providing a second circuit means connecting the second suction pipe to the vacuum means, the second conduit means including a second vacuum controller operable to selectively interconnect the vacuum means with the second suction pipe and apply vacuum to deliquefy the fabric passing thereover; positioning the first liquid source between the first and second suction pipes; providing a second liquid source positioned so that the second suction pipe is between the first and second liquid source in the direction of travel of the fabric; providing the second liquid source in the form of a liquid shower for depositing a predetermined amount of liquid on the fabric before it passes over the slot in the second suction pipe; providing an arrangement of pull rolls between the second suction pipe and the first liquid source for further dewatering the fabric after it leaves the second suction pipe and for guiding the fabric through the liquid supply source, compressing the fabric after it exits from the first liquid source to dewater the fabric, and providing guide rolls for guiding the fabric over the slot in the first suction pipe and directing the fabric from the first suction pipe.

* * * * *